US011295907B2

(12) United States Patent
Lee

(10) Patent No.: US 11,295,907 B2
(45) Date of Patent: Apr. 5, 2022

(54) BACKLIGHT MODULE AND OPERATION METHOD THEREOF

(71) Applicants: LITE-ON ELECTRONICS (GUANGZHOU) LIMITED, Guangzhou (CN); LITE-ON TECHNOLOGY CORPORATION, Taipei (TW)

(72) Inventor: Hsi-Wang Lee, Taipei (TW)

(73) Assignees: LITE-ON ELECTRONICS (GUANGZHOU) LIMITED; LITE-ON TECHNOLOGY CORPORATION

( * ) Notice: Subject to any disclaimer, the term of this patent is extended or adjusted under 35 U.S.C. 154(b) by 0 days.

(21) Appl. No.: 17/152,273

(22) Filed: Jan. 19, 2021

(65) Prior Publication Data

US 2021/0352786 A1 Nov. 11, 2021

Related U.S. Application Data

(60) Provisional application No. 63/021,174, filed on May 7, 2020.

(30) Foreign Application Priority Data

Dec. 4, 2020 (CN) ..... 202011409294.5

(51) Int. Cl.

| | |
|---|---|
| ***H01H 13/06*** | (2006.01) |
| ***H01H 13/14*** | (2006.01) |
| ***H05B 45/20*** | (2020.01) |
| ***H05B 45/46*** | (2020.01) |
| *H01H 13/83* | (2006.01) |

(52) U.S. Cl.

CPC ..... *H01H 13/06* (2013.01); *H01H 13/14* (2013.01); *H05B 45/20* (2020.01); *H05B 45/46* (2020.01); *H01H 13/83* (2013.01)

(58) Field of Classification Search

CPC ..... H05B 45/20; H05B 45/46; H01H 13/83

See application file for complete search history.

(56) References Cited

U.S. PATENT DOCUMENTS

| | | | | |
|---|---|---|---|---|
| 8,492,983 | B1 * | 7/2013 | Berg | H05B 47/18 315/185 R |
| 2018/0376566 | A1 * | 12/2018 | Newton | H05B 47/18 |
| 2020/0312225 | A1 * | 10/2020 | Hussell | G09G 3/2003 |

* cited by examiner

*Primary Examiner* — Daniel D Chang

(57) ABSTRACT

A backlight module is provided. The backlight module includes a backlight control circuit and a plurality of multiple light-emitting elements coupled in series and coupled to the backlight control circuit. The backlight control circuit transmits a packet. Each of the light-emitting elements compares an address of the packet with an individual address of each of the light-emitting elements. When the address of the packet matches the individual address of a target light-emitting element of the light-emitting elements, the target light-emitting element emits light according to a light-emitting data of the packet. Each of the light-emitting elements transmits the packet to a next light-emitting element.

8 Claims, 1 Drawing Sheet

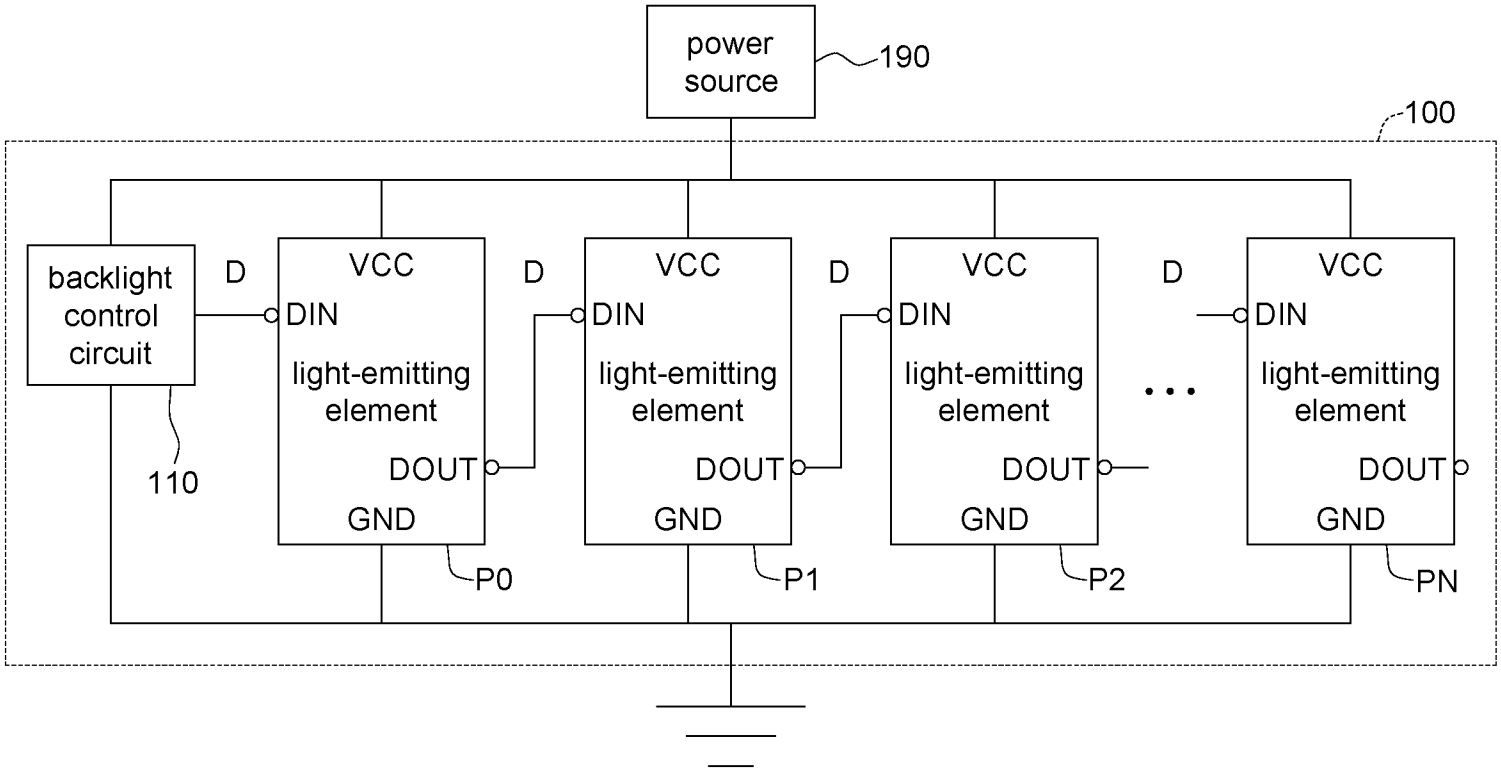
100
190
power source
backlight control circuit
110
D
VCC
DIN
light-emitting element
DOUT
GND
P0
P1
P2
PN

BACKLIGHT MODULE AND OPERATION METHOD THEREOF

This application claims the benefit of U.S. provisional application Ser. No. 63/021,174, filed May 7, 2020, and People's Republic of China application Serial No. 202011409294.5, filed Dec. 4, 2020, the subject matters of which are incorporated herein by reference.

BACKGROUND OF THE INVENTION

Field of the Invention

The invention relates in general to a backlight module and an operation method thereof.

Description of the Related Art

Light-emitting keyboards and mice, particularly gaming keyboards and mice, have gradually been used by users wishing to enhance their gaming experience.

Currently, a light-emitting keyboard or mouse normally includes multiple light-emitting elements, such as, color light-emitting diodes (LEDs) and at least one LED driver IC. Normally, the LED driver IC drives the light-emitting elements using a time-division multiplexing technology. To drive the light-emitting elements, the LED driver IC is coupled to the light-emitting elements via a signal line, making the layout of signal tracing between the light-emitting elements and the LED driver IC becomes more complicated.

SUMMARY OF THE INVENTION

The present invention is directed to a backlight module and an operation method thereof dispensing with the use of an LED driver IC and therefore simplifying the layout of signal tracing.

According to one embodiment the present invention, a backlight module is provided. The backlight module includes: a backlight control circuit and multiple light-emitting elements coupled in series and coupled to the backlight control circuit. The backlight control circuit transmits a packet. Each of the light-emitting elements compares an address of the packet with an individual address of each of the light-emitting elements. When the address of the packet matches the individual address of a target light-emitting element of the light-emitting elements, the target light-emitting element emits light according to a light-emitting data of the packet. Each of the light-emitting elements transmits the packet to a next light-emitting element.

According to another embodiment the present invention, an operation method of a backlight module is provided. The operation method includes: transmitting a packet; comparing an address of the packet with an individual address of each of the light-emitting elements by the backlight module, wherein the light-emitting elements are coupled in series; when the address of the packet matches the individual address of a target light-emitting element of the light-emitting elements, emitting light by the target light-emitting element according to a light-emitting data of the packet; and transmitting the packet to a next light-emitting element by each of the light-emitting elements.

The above and other aspects of the invention will become better understood with regard to the following detailed description of the preferred but non-limiting embodiment(s). The following description is made with reference to the accompanying drawings.

BRIEF DESCRIPTION OF THE DRAWINGS

FIG. 1 is a functional block diagram of a backlight module according to the present invention an embodiment.

DETAILED DESCRIPTION OF THE INVENTION

Detailed descriptions of the principles of structures and operations of the present invention are disclosed below with accompanying drawings.

FIG. 1 is a functional block diagram of a backlight module according to the present invention an embodiment. In an embodiment as indicated in FIG. 1, the backlight module 100 of the present invention includes a backlight control circuit 110 and multiple light-emitting elements P0-PN. Here, the light-emitting elements P0-PN (N is a positive integer) are exemplified by color LEDs, but the present invention is not limited thereto.

The backlight control circuit 110 is coupled to the light-emitting elements P0-PN (such as the light-emitting element P0). The light-emitting elements P0-PN are coupled in series and configured to provide color lights to a keyboard or a mouse. The backlight control circuit 110 and the light-emitting elements P0-PN are coupled and powered in parallel. That is, the backlight control circuit 110 and the light-emitting elements P0-PN are coupled to the power source 190 in parallel and are powered in parallel by the power source 190.

Each of the light-emitting elements P0-PN is allocated to a relevant address. For example, the light-emitting elements P0-PN are respectively allocated to the addresses A0-AN.

Each of the light-emitting elements P0-PN includes 4 pins, namely a power pin VCC, a data input pin DIN, a data output pin DOUT and a ground pin GND. The power pins VCC of the light-emitting elements P0-PN are electrically coupled to the power source 190 to receive power from the power source 190. The data input pin DIN of each of the light-emitting elements P0-PN is electrically coupled to the data output pin DOUT of a previous one of the light-emitting elements P0-PN, wherein, the data input pin DIN of the light-emitting element P0 is electrically coupled to the backlight control circuit 110. The data output pin DOUT of each of the light-emitting elements P0-PN is electrically coupled to the data input pin DIN of a next one of the light-emitting elements P0-PN, wherein, the data output pin DOUT of the light-emitting element PN is floating. The ground pins GND of the light-emitting elements P0-PN is grounded.

When the backlight module 100 emits light, the backlight control circuit 110 transmits a packet D to the light-emitting element P0. The packet D includes an address A and a light-emitting data. The light-emitting data includes multiple bits. Here, the light-emitting elements P0-PN are exemplified by RGB color LEDs, wherein the red color, the green color and the blue color of each of the RGB color LEDs are respectively controlled by 8 bits. Therefore, the light-emitting data of the packet D includes 24 bits, namely green bits G7-G0, red bits R7-R0 and blue bits B7-B0, wherein each of the bits G7-G0, R7-R0 and B7-B0 is 1 bit.

When the light-emitting element P0 receives the packet D from the backlight control circuit 110, the light-emitting element P0 decodes the packet D to obtain the address A and the light-emitting data of the packet D. The light-emitting element P0 compares the address A of the packet D with the individual address A0 of the light-emitting element P0. When the address A of the packet D matches the individual address A0 of the light-emitting element P0 (also referred as the 1$^{st}$ address), the light-emitting element P0 emits light according to the light-emitting data of the packet D. Conversely, when the address A of the packet D does not match the address of the light-emitting element P0, the light-emitting element P0 abandons the packet D and further transmits the packet D to the data input pin DIN of a next light-emitting element P1 via the individual the data output pin DOUT of the light-emitting element P0. Then, the light-emitting element P1 performs similar operations to determine whether to emit light or abandon the packet D and further transmits the packet D to the next light-emitting element P2. By the same analogy, each of the light-emitting elements P0-PN receives and decodes the packet D to determine whether to emit light or abandon the packet D and further transmits the packet D to a next light-emitting element.

In another embodiment of the present invention, when the light-emitting element P0 receives the packet D from the backlight control circuit 110, the light-emitting element P0 decodes the packet D to obtain the address A and the light-emitting data of the packet D. The light-emitting element P0 compares the address A of the packet D with the individual address A0 of the light-emitting element P0. When the address A of the packet D matches the individual address A0 of the light-emitting element P0 (also referred as the 1$^{st}$ address), the light-emitting element P0 does not transmit the packet D to a next one of the light-emitting elements P1-PN but emits light according to the light-emitting data of the packet D. To achieve the above object, the address A and the light-emitting data of the packet D are controlled according to the sequence in timing. For example, after the packet D of the address A (A=A4) is outputted, the packet D sequentially passes through the light-emitting elements P0, P1, P2, P3 and P4, wherein, a counting value is added by 1 whenever the packet D passes through one of the light-emitting elements. The light-emitting element P4 compares the address A of the packet D (A=A4) with the individual address A4 of the light-emitting element P4. When the address A of the packet D (A=A4) matches the individual address A4 of the light-emitting element P4, the light-emitting element P4 does not transmit the packet D to the following light-emitting elements P5-PN but emits light according to the light-emitting data of the packet.

In an embodiment of the present invention, the physical positions of the light-emitting elements P0-PN are relevant to the key positions of a keyboard or the key positions of a mouse. In a possible embodiment, the physical positions of the light-emitting elements P0-PN of a light-emitting keyboard one-to-one correspond to the key positions of the light-emitting keyboard (that is, each of the light-emitting elements P0-PN provides backlight to its corresponding key). In another possible embodiment, the physical positions of the light-emitting elements P0-PN of a light-emitting keyboard one-to-one correspond to the key groups of the light-emitting keyboard, wherein each key group includes multiple keys (each of the light-emitting elements P0-PN provides backlight to multiple keys). The above arrangements are all within the scope of protection of the present invention.

The present invention further provides another operation method of a backlight module. The operation method of a backlight module includes: transmitting a packet; comparing an address of the packet with an individual address of each of the light-emitting elements by multiple light-emitting elements of the backlight module, wherein the light-emitting elements are coupled in series; when the address of the packet matches the individual address of a target light-emitting element of the light-emitting elements, emitting light by the target light-emitting element according to a light-emitting data of the packet; and transmitting the packet to a next light-emitting element by each of the light-emitting elements.

To summarize, since the LED driver IC is not used in the above embodiments of the present invention, circuit cost of the backlight module of the present invention is reduced.

Besides, in the above embodiments of the present invention, the backlight control circuit and the light-emitting elements P0-PN are coupled in series, but the light-emitting elements P0-PN are coupled and powered in parallel. Therefore, the layout of signal tracing of the backlight module of the present invention is simplified.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A backlight module, comprising:

a backlight control circuit; and a plurality of light-emitting elements coupled in series and coupled to the backlight control circuit, wherein, the backlight control circuit transmits a packet;

each of the light-emitting elements compares an address of the packet with an individual address of each of the light-emitting elements;

when the address of the packet matches the individual address of a target light-emitting element of the light-emitting elements, the target light-emitting element emits light according to a light-emitting data of the packet;

each of the light-emitting elements transmits the packet to a next light-emitting element;

the backlight control circuit and the light-emitting elements are powered in parallel;

the address of the packet and the light-emitting data of the packet are controlled according to a sequence in timing; and after the packet is outputted, the packet sequentially passes through the light-emitting elements, wherein a counting value is added whenever the packet passes through one of the light-emitting elements.

2. The backlight module according to claim 1, wherein, when the address of the packet does not match the individual address of the target light-emitting element, the target light-emitting element abandons the packet; and when the address of the packet matches the individual address of the target light-emitting element of the light-emitting elements, the target light-emitting element does not transmit the packet to the next light-emitting element but emits light according to the light-emitting data of the packet.

3. The backlight module according to claim 1, wherein, the light-emitting elements are color light-emitting diodes.

4. The backlight module according to claim 1, wherein, each of the light-emitting elements comprises a power pin, a data input pin, a data output pin and a ground pin;

the power pins of the light-emitting elements are electrically coupled to a power source;

the data input pin of each of the light-emitting elements is electrically coupled to the data output pin of a previous light-emitting element;

the data output pin of each of the light-emitting elements is electrically coupled to the data input pin of a next light-emitting element; and the ground pins of the light-emitting elements are grounded.

5. An operation method of a backlight module, comprising:

transmitting a packet;

comparing an address of the packet with an individual address of each of a plurality of light-emitting elements of the backlight module by the light-emitting elements of the backlight module, wherein the light-emitting elements are coupled in series;

when the address of the packet matches the individual address of a target light-emitting element of the light-emitting elements, emitting light by the target light-emitting element according to a light-emitting data of the packet; and transmitting the packet to a next light-emitting element by each of the light-emitting elements;

wherein the light-emitting elements are powered in parallel;

the address of the packet and the light-emitting data of the packet are controlled according to a sequence in timing; and after the packet is outputted, the packet sequentially passes through the light-emitting elements, wherein a counting value is added whenever the packet passes through one of the light-emitting elements.

6. The operation method of a backlight module according to claim 5, wherein, when the address of the packet does not match the individual address of the target light-emitting element, the target light-emitting element abandons the packet; and when the address of the packet matches the individual address of the target light-emitting element of the light-emitting elements, the target light-emitting element does not transmit the packet to the next light-emitting element but emits light according to the light-emitting data of the packet.

7. The operation method of a backlight module according to claim 5, wherein, the light-emitting elements are color light-emitting diodes.

8. The operation method of a backlight module according to claim 5, wherein, each of the light-emitting elements comprises a power pin, a data input pin, a data output pin and a ground pin;

the power pins of the light-emitting elements are electrically coupled to a power source;

the data input pin of each of the light-emitting elements is electrically coupled to the data output pin of a previous light-emitting element;

the data output pin of each of the light-emitting elements is electrically coupled to the data input pin of a next light-emitting element; and the ground pins of the light-emitting elements are grounded.

* * * * *